US006327975B1

(12) United States Patent
Izawa

(10) Patent No.: US 6,327,975 B1
(45) Date of Patent: Dec. 11, 2001

(54) METHOD AND APPARATUS FOR PRINTING ELONGATE IMAGES ON A WEB

(75) Inventor: Hideo Izawa, Chiba (JP)

(73) Assignee: Miyakoshi Printing Macinery Co., Ltd., Chiba (JP)

( * ) Notice: Subject to any disclaimer, the term of this patent is extended or adjusted under 35 U.S.C. 154(b) by 0 days.

(21) Appl. No.: 09/589,203

(22) Filed: Jun. 8, 2000

(30) Foreign Application Priority Data

Sep. 17, 1999 (JP) ..... 11-263955

(51) Int. Cl.[7] ..... B41M 1/10; B41F 5/16; B41F 13/24

(52) U.S. Cl. ..... 101/170; 101/181; 101/182; 101/219; 101/225; 101/247

(58) Field of Search ..... 101/485, 486, 101/483, 490, 211, 247, 138, 139, 170, 181, 182, 183, 184, 218, 219, 221, 225

(56) References Cited

U.S. PATENT DOCUMENTS

| | | | | |
|---|---|---|---|---|
| Re. 34,483 | * | 12/1993 | Bowman et al. | 101/138 |
| 4,108,067 | | 8/1978 | Werner . | |
| 4,437,402 | * | 3/1984 | Fischer | 101/181 |
| 4,805,111 | * | 2/1989 | Steidel | 101/181 |
| 4,860,649 | * | 8/1989 | Popkins | 101/247 |
| 5,415,092 | * | 5/1995 | Hern | 101/248 |
| 5,546,859 | * | 8/1996 | Hern | 101/226 |
| 5,771,811 | * | 6/1998 | Siler et al. | 101/486 |
| 5,787,807 | * | 8/1998 | Rodi | 101/483 |
| 5,813,336 | * | 9/1998 | Guaraldi et al. | 101/247 |

FOREIGN PATENT DOCUMENTS

| | | |
|---|---|---|
| 116 450 | 12/1897 | (DE) . |
| 41 04 209 | 8/1992 | (DE) . |
| 980m734 | 5/1951 | (FR) . |
| 63-189633 | 12/1988 | (JP) . |
| 95/20488 | 8/1995 | (WO) . |

* cited by examiner

*Primary Examiner*—Eugene Eickholt
(74) *Attorney, Agent, or Firm*—Wenderoth, Lind & Ponack, L.L.P.

(57) ABSTRACT

A web-fed offset printing press has printing units each comprising a plate cylinder, a blanket cylinder, and an impression cylinder, the impression cylinder being movable into and out of rolling engagement with the blanket cylinder via the web. A first printing unit prints a first image portion on the web at prescribed spacings, by moving the impression cylinder away from the blanket cylinder each time one first image portion is printed. A second printing unit prints a second image portion on the spacings left on the web by the first printing unit, also by moving the impression cylinder away from the blanket cylinder each time one second image portion is printed. A variable speed motor rotates each blanket cylinder, while each time the associated impression cylinder is held away to create a space on the web for causing printing of the first or the second printing portion at required spacings.

7 Claims, 4 Drawing Sheets

METHOD AND APPARATUS FOR PRINTING ELONGATE IMAGES ON A WEB

BACKGROUND OF THE INVENTION

This invention relates to a web-fed printing press having at least two printing units in a row for printing an image whose dimension in the longitudinal direction of the web is longer than the circumference of the plate cylinder of each unit. The invention also deals with a method of printing such images on the web without intervening blanks between the printed images.

Printing firms are sometimes requested by clients to produce printings as large as, say, from 70 inches (1778 millimeters) to 90 inches (2286 millimeters) in top-to-bottom dimension (i.e., dimension determined by the circumference of the printing cylinder, or dimension in the longitudinal direction of the web on which the printings are made). For offset printing of such large images, the most widespread conventional practice has been to prepare and keep in stock an assortment of outsize plate cylinders, as well as blanket cylinders to match, with a diameter of 23.6 inches (600 millimeters) and thereabouts, for various sizes of printings to be made. Such outsize cylinders have been interchangeably mounted to printing presses as the need arises.

This conventional practice is objectionable by reason of the outsize plate cylinders and blanket cylinders themselves and, of course, of the presses of matching size required by such cylinders. All such equipment demand inordinately high costs for manufacture, installation, operation, and storage.

Another known method involves the use of a relief or letterpress printing plate in the form of an endless belt running over a plate cylinder and a guide roller or rollers. The plate cylinder is, in fact, a sprocket having teeth for positive engagement in series of perforations formed in the side margins of the endless belt. The elongate image is imprinted from the belt on to the web running against an impression cylinder.

The relief printing belt does, however, possess the weakness of being not so satisfactory in the quality of printing as that by offset printing. The printings made by this prior art method is also unsatisfactory in positional accuracy as the plate takes the form of an endless belt and is driven by the sprocket. The service life of the printing belt is questionable, too, by reason of the presence of the perforations in its side margins.

The listed drawbacks of the two foregoing devices are altogether absent from a more advanced printing system according to Japanese Unexamined Patent Publication No. 63-189633. This patent application suggests use of two or more printing units in serial arrangement for printing on a web running successively therethrough. As the printing units prints different sections of an image at prescribed spacings on the web, the image sections provide in combination the image of any desired top-to-bottom dimension up to the sum of the circumferences of all the plate cylinders in use.

This third prior art approach, though definitely more favorable than the first two, has its own shortcomings. It had, first of all, limitations in the top-to-bottom dimension of the printings to be made. Since the plate cylinders of all the printings units were in constant rotation at the same peripheral speed as the running speed of the web, the spacings left unprinted by each printing unit were each equal to the circumference of each plate cylinder, or to an integral multiple thereof. The top-to-bottom dimension of each image thus printed, constituted of the sections printed by the respective units, was therefore limited to the total of the circumferences of all the plate cylinders if no blanks were to be left on the web.

If, on the other hand, images were to be printed whose top-to-bottom dimensions were less than the total of the circumferences of the plate cylinders, blanks were unavoidably created between the printed images on the web, each blank being equal to the difference between the total circumferential dimension of the plate cylinders and the image dimension in the longitudinal direction of the web. The blanks are nothing less than a waste of paper. Moreover, they necessitated the additional post-printing operations of cutting off the blanks and disposing of the cuttings.

SUMMARY OF THE INVENTION

The present invention has it as an object to produce printings of practically any desired top-to-bottom dimension on a continuous web of paper or the like without creation of intervening blanks.

Speaking generally, the invention is applicable to a variety of printing presses built on different operating principles typically including offset printing. In offset printing, as is well known, the inked image is first printed on a blanket cylinder, from which the image is offset or transferred to the web running against an impression cylinder. In most other types of printing presses, however, the image is printed directly from the plate cylinder to the web also running against an impression cylinder. Therefore, in the following summary of the invention and in the claims appended hereto, the term "printing cylinder" will be used to refer both to the blanket cylinder of offset printing and to the plate cylinder of other printing principles.

Briefly stated in one aspect thereof, the present invention concerns, in a web-fed rotary printing press, a method of printing elongate images on a continuous web of paper or like material. The method presupposes use of a first printing unit wherein a first printing cylinder coacts with a first impression cylinder for printing on the web a first image portion having a first dimension, in the longitudinal direction of the web, that is not more than the circumference of the first printing cylinder, and a second printing unit wherein a second printing cylinder coacts with a second impression cylinder for printing on the web a second image portion having a second dimension, in the longitudinal direction of the web, that is not more than the circumference of the second printing cylinder.

The first printing unit prints the first image portion on the web at prescribed spacings, by moving the first impression cylinder away from the first printing cylinder each time one first image portion is printed. The second printing unit prints the second image portion on the spacings left on the web by the first printing unit, also by moving the second impression cylinder away from the second printing cylinder each time one second image portion is printed.

Perhaps according to a most pronounced feature of the invention, the printing cylinder of each printing unit is rotated, while each time the associated impression cylinder is held away therefrom for creation of a space on the web, at a variable speed through an angle necessary for causing the first or the second printing portion to be printed at the required spacings.

Thus, each printing cylinder may be driven, when the impression cylinder is held away therefrom, faster or slower than when the impression cylinder is urged against the same via the web, and in relation to the traveling speed of the web.

Such a variable speed rotation of the printing cylinder makes it possible for each printing unit to print the image portion at any desired spacings, which are to be, or have been, filled by the image portion printed by the other printing unit. Images can thus be printed on the web without intervening blanks. Being comprised of the first and the second image portion, each image can be of a greater dimension in the longitudinal web direction than the circumference of the printing cylinder of either printing unit, up to the sum of the circumferences of the printing cylinders of both printing units.

Another aspect of the invention concerns a printing press constructed for carrying the above summarized method into effect. All the necessary means according to the invention, including the variable speed motors for driving the printing cylinders, can be compactly and inexpensively built into a printing press of otherwise familiar construction.

The above and other objects, features and advantages of this invention and the manner of achieving them will become more apparent, and the invention itself will best be understood, from a study of the following description and attached claims, with reference to the accompanying drawings showing a preferred embodiment of the invention.

DESCRIPTION OF THE PREFERRED EMBODIMENT

Figure 1:
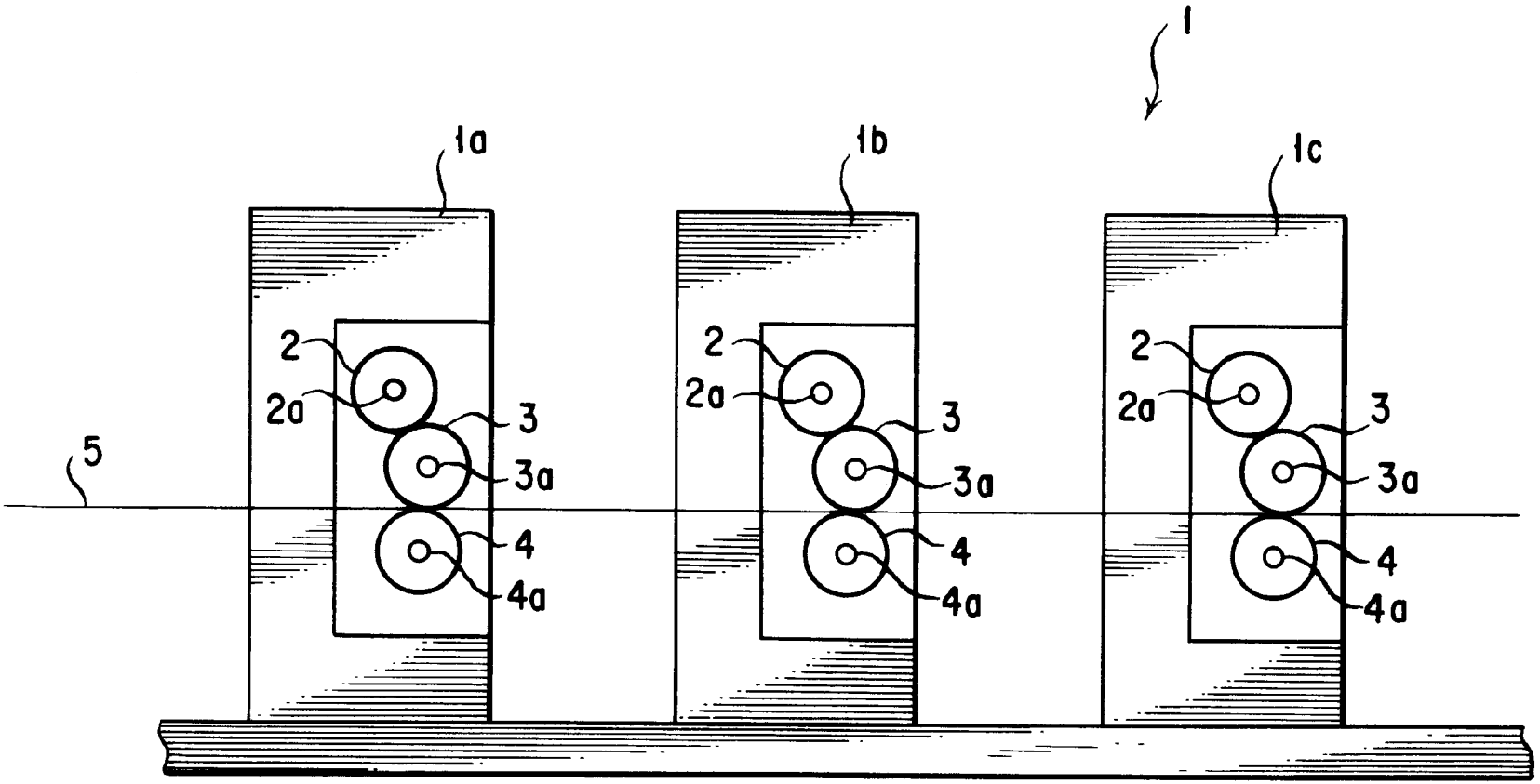
FIG. 1 is a schematic diagram of a web-fed offset rotary printing press to which the present invention finds application, the printing press having three printing units of like construction by way of example.

The present invention is currently believed to be best applicable to the web-fed offset rotary printing press largely configured as depicted in FIG. 1 and therein generally designated 1. The machine 1 is shown to have three printing units 1*a*, 1*b* and 1*c* in a row, although the invention requires only two such units at a minimum. Each of the printing units 1*a*–1*c* conventionally comprises a plate cylinder 2, a blanket cylinder 3, and an impression cylinder 4. The plate cylinder 2 prints the inked image on the blanket cylinder 3, from which the image is offset to a continuous web 5 of paper or the like running against the impression cylinder 4.

Figure 2:
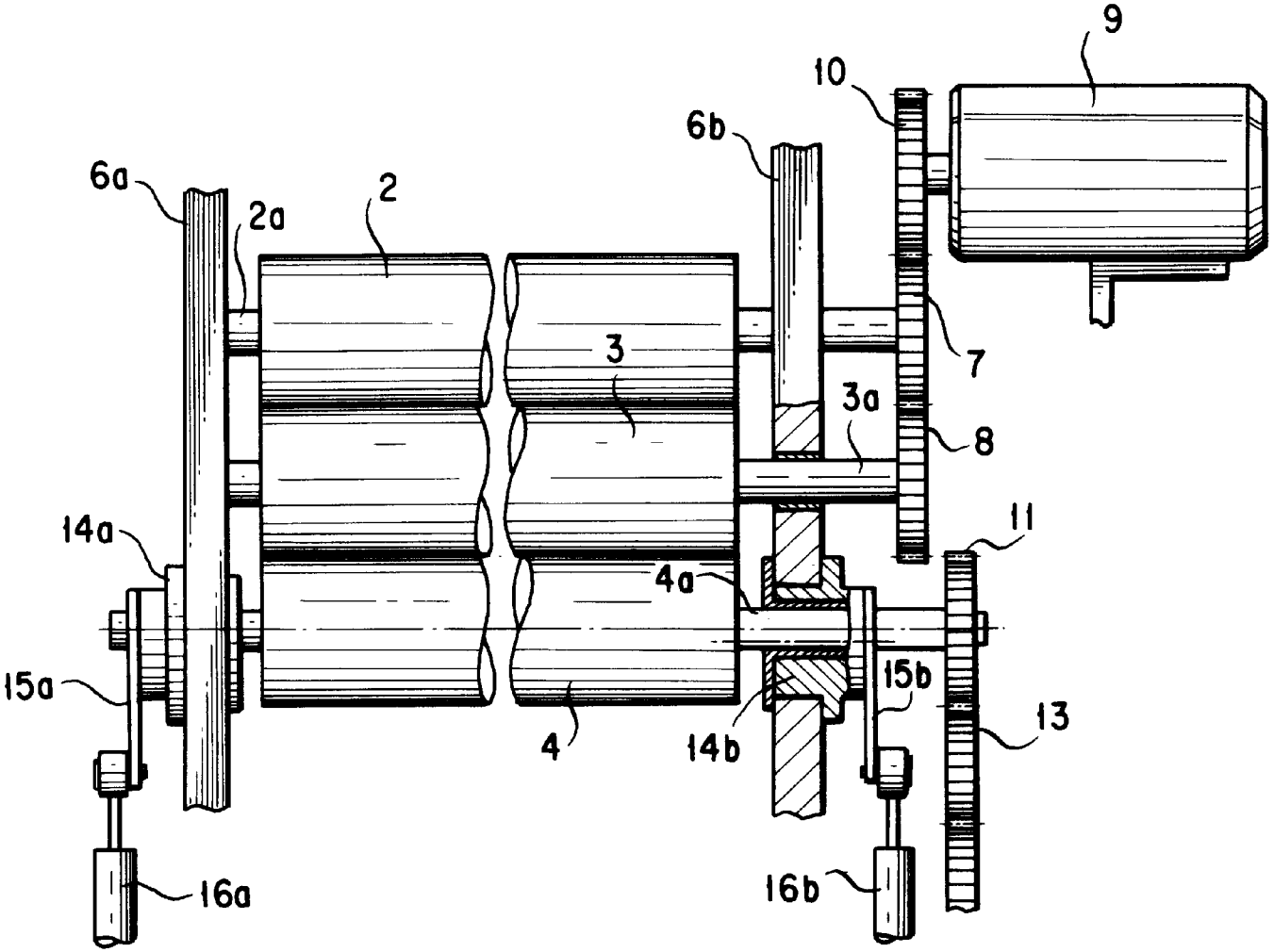
FIG. 2 is an enlarged, fragmentary elevational view, partly shown broken away for illustrative convenience and partly shown sectioned for clarity, showing one of the printing units of the FIG. 1 printing press.

As better illustrated in FIG. 2, the plate cylinder 2, blanket cylinder 3, and impression cylinder 4 of each printing unit are mounted on shafts 2*a*, 3*a* and 4*a*, respectively, for joint rotation therewith. These shafts 2*a*–4*a* are rotatably mounted to and between a pair of framing walls 6*a* and 6*b* confronting each other across the path of the web 5.

Figure 3:
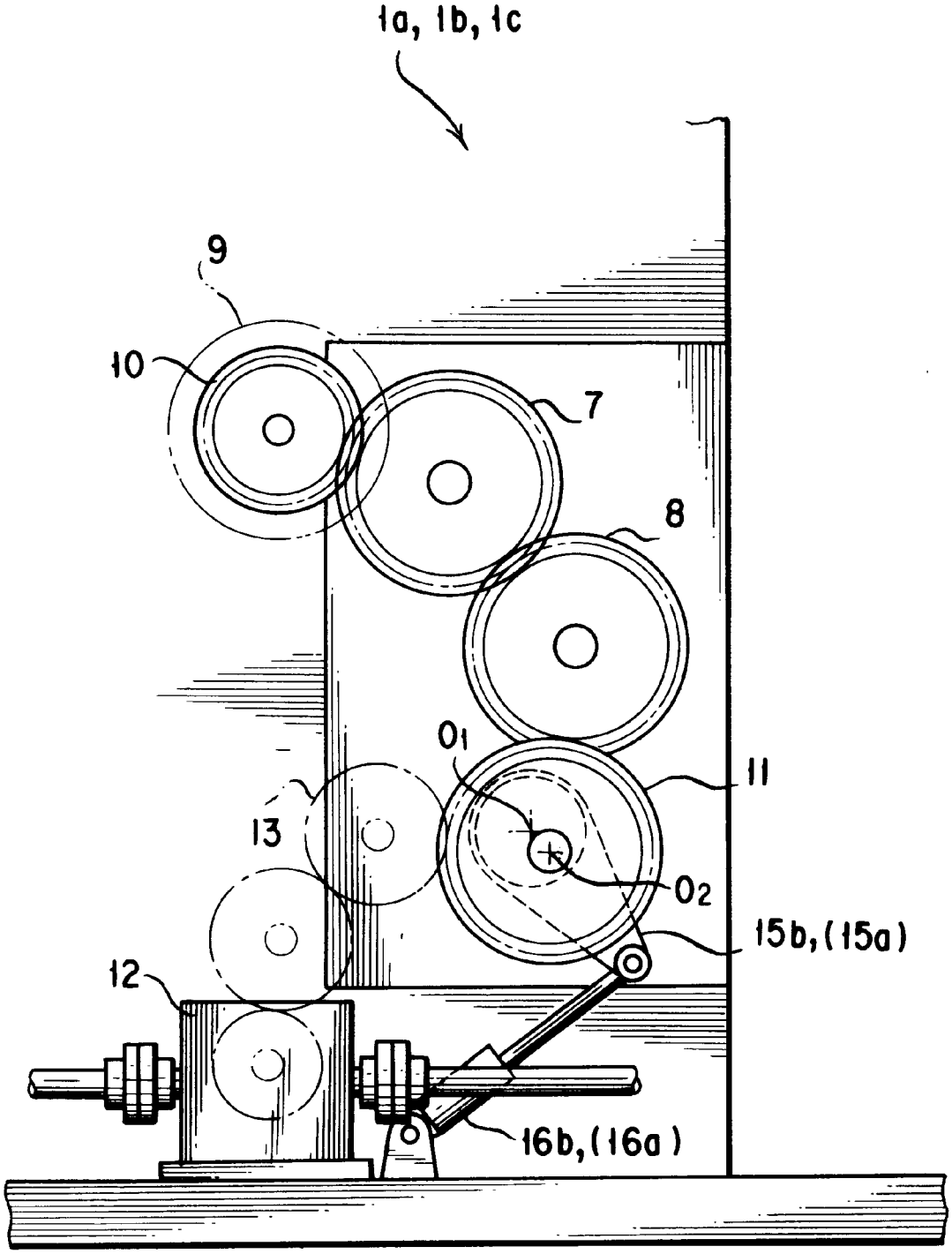
FIG. 3 is a right hand side elevation of FIG. 2.

In this particular embodiment, according to the principles of this invention, the plate cylinder 2 and blanket cylinder 3 of each printing unit are to be jointly rotated at a variable speed independently of the impression cylinder 4 while not printing on the web 5. A reference to both FIGS. 2 and 3 will reveal that two intermeshing gears 7 and 8 of the same diameter, tooth number, pitch, etc., are nonrotatably mounted on the shafts 2*a* and 3*a* of the plate cylinder 2 and blanket cylinder 3. Each printing unit is further provided with its own variable speed electric motor 9 for driving the plate cylinder 2 and blanket cylinder 3. Mounted on the armature shaft of the variable speed motor 9, a drive gear 10 is in constant mesh with the driven gear 7 on the plate cylinder shaft 2*a* and thence with the other driven gear 8 on the blanket cylinder shaft 3*a*.

On the impression cylinder shaft 4*a*, on the other hand, there is nonrotatably mounted a driven gear 11 which is coupled via a gear train 13 to a gearbox 12 on the standard drive shaft driving the impression cylinders 4 of all the printing units 1*a*–1*c* as well as the various working parts of other processing stations of the press 1. The impression cylinder 4 is thus driven at the same peripheral speed as the traveling speed of the web 5.

Each printing unit is intended to print a different part of an image on the web 5 at variable spacings. The creation of such unprinted spaces on the web requires that the impression cylinder 4 be movable into and out of rolling engagement with the blanket cylinder 3 via the web 5, the web being printed upon only while being pressed against the blanket cylinder by the impression cylinder.

To that end, as clearly seen in FIG. 2, the impression cylinder 4 has its shaft 4*a* mounted to the pair of framing walls 6*a* and 6*b* via a pair of eccentric antifriction bearings 14*a* and 14*b*. These bearings are themselves rotatable relative to the framing walls 6*a* and 6*b* about a common axis $O_1$, FIG. 2. The impression cylinder shaft 4*a*, however, is supported eccentrically by the bearings 14*a* and 14*b*, so that the axis $O_2$ of rotation of the impression cylinder shaft relative to the bearings is off the axis $O_1$ of rotation of the bearings relative to the frame walls 6*a* and 6*b*.

Extending in the same direction from the bearings 14*a* and 14*b* are a pair of levers or crank arms 15*a* and 15*b* which are pin jointed respectively to a pair of fluid actuated cylinders 16*a* and 16*b*. The joint extension and contraction of the cylinders 16*a* and 16*b* result in bidirectional rotation of the bearings 14*a* and 14*b* relative to the framing walls 6*a* and 6*b*, hence in the arcuate displacement of the impression cylinder shaft 4*a* about the axis $O_1$ of the bearings, and hence in the travel of the impression cylinder 4 into and out of rolling contact with the blanket cylinder 3.

Such being the construction of the printing press 1 according to the invention, the web 5 may be fed into and through the successive printing units 1*a*–1*c* at a prescribed constant speed. The impression cylinders 4 of all the printing units may be maintained in rotation at the same peripheral speed as the running speed of the web 5 irrespective of whether the impression cylinders are held against or spaced from the blanket cylinders 3. The plate cylinders 2 and blanket cylinders 3 of the printing units 1*a*–1*c* are to be driven at the same peripheral speed as the running speed of the web 5 when the impression cylinders 4 are held against the blanket cylinders via the web, and at a higher or lower peripheral speed than the running speed of the web when the impression cylinders are retracted. The rotational speeds of the plate cylinders 2 and blanket cylinders 3 are individually controllable as aforesaid by the variable speed motors 9 provided one to each printing unit.

The following is a discussion of how elongate images are printed on the web 5 by use of two printing units 1*a* and 1*b* of the FIG. 1 machine 1 and by the method of this invention. Let us suppose that the plate cylinder 2 and blanket cylinder 3 of each printing unit are each forty-five inches in circumference. Also assume that, as indicated in FIG. 4, each image to be printed is seventy inches in top-to-bottom dimension, and that each such image on the web 5 is to be constituted of a forty-inch first image portion, which is to be printed by the first printing unit 1*a,* and a thirty-inch second image portion to be printed by the second printing unit 1*b*.

Figure 4:
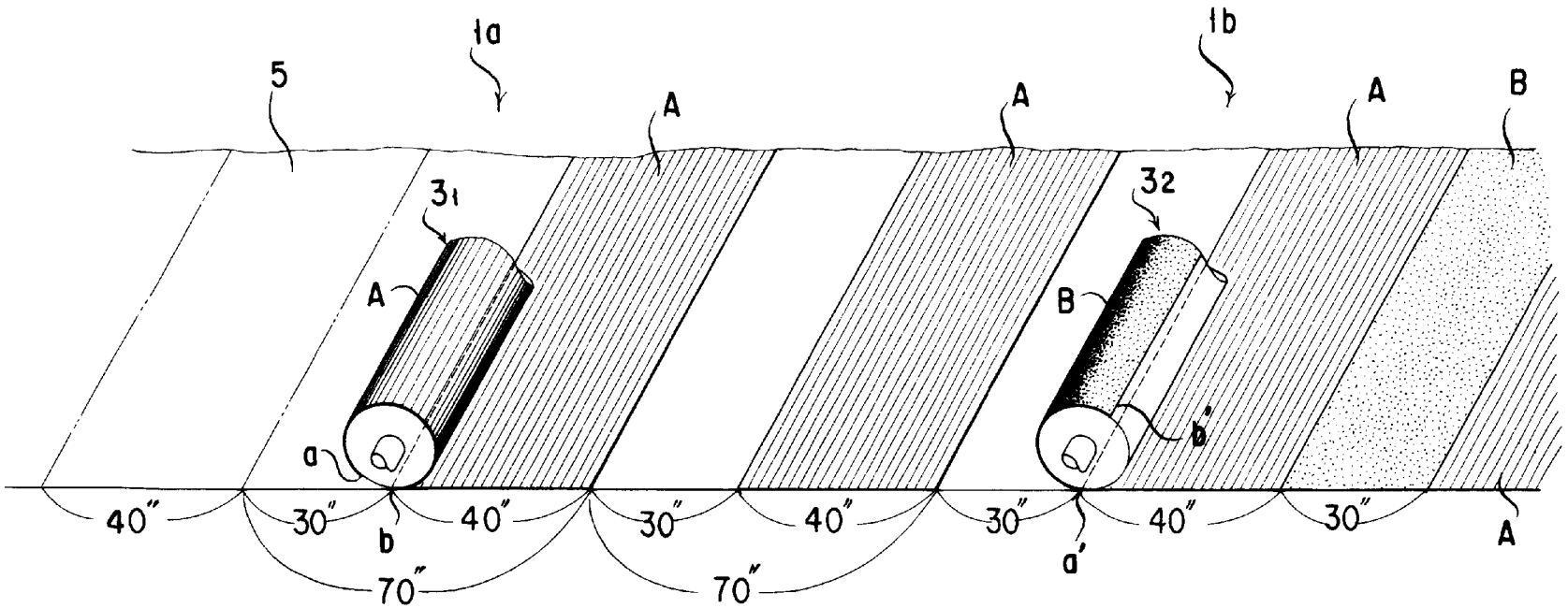
FIG. 4 is a partial perspective view explanatory of how elongate images are printed on the web without intervening blocks by two of the printing units of the FIG. 1 printing press.

In FIG. 4 the first image portions A which have been printed on the web 5 are indicated by hatching, and the second image portion B which has been printed on the web, by fine dots. This figure also shows, for clarity, only fragments of the blanket cylinders $\mathbf{3}_1$ and $\mathbf{3}_2$ of the printing units 1*a* and 1*b* in addition to the web 5.

Referring more specifically to FIG. 4, the first blanket cylinder $\mathbf{3}_1$ is therein shown just upon completion of printing one forty-inch first image portion A. The first blanket cylinder $\mathbf{3}_1$ has revolved from a to b through the greater part of its circumference, with the associated impression cylinder held against the same, for printing that one first image portion A.

The next step is the creation, by the first printing unit 1*a*, of one thirty-inch spacing on the web, to be later filled in with a second image portion B by the second printing unit 1*b*. The impression cylinder of the first printing unit 1*a* must be held away from the first blanket cylinder $\mathbf{3}_1$ while the web 5 travels thirty inches.

Further, during this thirty-inch travel of the web 5, the first blanket cylinder $\mathbf{3}_1$ must rotate through an angle necessary for bringing the leading edge a of the first image portion printed thereon to the angular position exactly opposite the web 5 at the end of its thirty-inch travel. To this end the first blanket cylinder $\mathbf{3}_1$ must revolve from b to a through the smaller part of its circumference. This smaller circumferential part from b to a is five inches whereas the web 5 travels thirty inches. The peripheral speed of the first blanket cylinder $\mathbf{3}_1$ must therefore be less than the running speed of the web 5 by an amount corresponding to the twenty-five-inch difference.

Then, at the end of the thirty-inch travel of the web 5 and the five-inch circumferential displacement of the first blanket cylinder 3, the impression cylinder 4 of the first printing unit 1*a* may be reactuated into rolling contact with the first blanket cylinder $\mathbf{3}_1$ via the web. The first blanket cylinder $\mathbf{3}_1$ may then be driven at the same peripheral speed as the traveling speed of the web. Another first image portion A will now be printed on the web.

The foregoing cycle of operation may be repeated as the web continues running at prescribed speed. The first printing unit 1*a* will repeatedly print the forty-inch first image portion A on the web 5 at thirty-inch spacings.

Positioned downstream of the first printing unit 1*a* with respect to the traveling direction of the web 5, the second printing unit 1*b* is to print the second image portion B on the web blanks left between the first image portions A printed thereon by the first printing unit. The angular position of the blanket cylinder $\mathbf{3}_2$ of this second printing unit must be so preadjusted in relation to that of the first blanket cylinder $\mathbf{3}_1$ that the leading edge a' of the second image portion B on the second blanket cylinder $\mathbf{3}_2$ comes exactly opposite the web 5 when the trailing edge of each first image portion A printed on the web comes exactly opposite the second blanket cylinder.

FIG. 4 shows the second blanket cylinder $\mathbf{3}_2$ in such an angular position with respect to the web 5. Then the associated impression cylinder may be actuated into contact with the second blanket cylinder $\mathbf{3}_2$ via the web 5, and the second blanket cylinder may be accelerated to the same peripheral speed as the running speed of the web, it being understood that the impression cylinder is in constant rotation at the same peripheral speed as the running speed of the web. The second image portion B will thus be printed on the web upon subsequent rotation of the second blanket cylinder $\mathbf{3}_2$ through an angle corresponding to thirty inches of its circumference.

Then the impression cylinder 4 may be withdrawn from the second blanket cylinder $\mathbf{3}_2$ to skip over the next first image portion A printed on the web 5. Then, during the following forty-inch travel of the web 5, the second blanket cylinder $\mathbf{3}_2$ may be revolved through an angle corresponding to fifteen inches of its circumference.

Thus, as the two printing units 1*a* and 1*b* repeatedly print the forth-inch first image portion A and the thirty-inch second image portion B, there will be produced on the web 5 a series of 70-inch images. No blanks will exist between such images as the plate cylinders 2 and blanket cylinders 3 of both printing units are independently drivable at any desired speed.

Although the present invention has been disclosed very specifically and as applied to an offset printing press, it is not desired that the invention be limited by the exact details of such disclosure. For instance, the blanket cylinders may be driven at a peripheral speed not necessarily lower, but higher, than the running speed of the web while the impression cylinder is held away therefrom, if the angular positions of the blanket cylinders are easier to control through such a higher speed rotation. Thus, in the case of production of seventy-inch images as in FIG. 4, the first blanket cylinder $\mathbf{3}_1$ may be rotated one complete revolution plus an angle corresponding to the difference between the circumference of the first blanket cylinder and the top-to-bottom dimension of the first image portion A. The second blanket cylinder $\mathbf{3}_2$ may likewise be rotated one complete revolution plus an angle corresponding to the difference between the circumference of the second printing cylinder and the top-to-bottom dimension of the second image portion B.

Another possible departure from the illustrated embodiment is the driving of the impression cylinder 4 of each printing unit from the blanket cylinder 3 instead of from the gearbox 12. The impression cylinder can then be driven in total synchronism with the blanket cylinder, with the impression cylinder held geared to the blanket cylinder even when spaced therefrom.

It will also readily occur to the printing press specialists to drive the inking rollers, not shown, for the plate cylinder of each printing unit by the variable speed motor 9. The inking rollers may then be driven at the same peripheral speed as the plate cylinder 2 even though the peripheral speed of this plate cylinder is subject to change with that of the blanket cylinder.

Furthermore, as has been set forth in the summary of the invention, it is applicable not only to offset printing but also to other printing principles in which the image is printed directly from the plate cylinder.

All such modifications, alterations and adaptations of this invention are intended in the foregoing disclosure. It is therefore appropriate that the invention be construed broadly and in a manner consistent with the fair meaning or proper scope of the claims which follow.

What is claimed is:

1. In a web-fed rotary printing press, a method of printing elongate images on a continous web of material, which method comprises:

(a) providing a first printing unit having a first printing cylinder and a first impression cylinder, the first printing cylinder coacting with the first impression cylinder for printing on a web a first image portion having a first dimension, in the longitudinal direction of the web, that is not more than the circumference of the first printing cylinder;

(b) providing a second printing unit having a second printing cylinder and a second impression cylinder, the second printing cylinder coacting with the second impression cylinder for printing on the web a second portion having a second dimension, in the longitudinal direction of the web, that is not more than the circumferene of the second printing cylinder;

(c) running a web at a prescribed speed through the first and the second printing unit;

(d) holding the first impression cylinder against the first printing cylinder via the web for causing the first image portion to be printed thereon;

(e) holding the first impression cylinder away from the first printing cylinder for causing the first image portion to be not printed on the web while the wb is traveling a first predetermined distance, which is equal to the second dimension, after each time the first image portion has been printed thereon;

(f) rotating, if necessary, the first printing cylinder through an angle necessary for again printing the first image portion on the web immediately after the web has traveled the first predetermined distance;

(g) again holding the first impression cylinder against the first printing cylinder via the web after the web has traveled the first predetermined distance, for causing the first image portion to be printed thereon, with the consequent creation of a blank between every two neighboring first image portion on the web, the blank being of the second dimension in the longitudinal direction of the web;

(h) holding the second impression cylinder against the second printing cylinder via the web for causing the second image portion to be printed on one of the blanks of the web left by the first printing unit;

(i) holding the second impression cylinder away from the second printing cylinder for causing the second image portion to be not printed on the web while the web is traveling a second predetermined distance, which is equal to the first dimension, after each time the second image portion has been printed thereon;

(j) rotating, if necessary, the second printing cyliinder through an angle necessary for printing the second image portion on the next blank on the web; and (k) again holding the second impression cylinder against the second printing cylinder via the web after the web has traveled the second predetermined distance, for causing the second image portion to be printed on the next blank on the web;

(l) whereby images can be printed on the web without intervening blanks, each printed image, if composed of the first and the second image portion, having a dimension in the longitudinal direction of the web up to the sum of the circumferences of the first and the second printing cylinder.

2. The method of claim 1 wherein the first and the second impression cylinder are maintained in rotation at the same peripheral speed as the running speed of the web.

3. The method of claim 1 wherein the first dimension of the first image portion is less than the circumference of the first printing cylinder of the first printing unit, and wherein the first printing cylinder is rotated, while the first impression cylinder is held away therefrom, one complete revolution plus an angle corresponding to the difference between the circumference of the first printing cylinder and the first dimension of the first image portion.

4. The method of claim 1 wherein the second dimension of the second image portion is less than the circumference of the second printing cylinder of the second printing unit, and wherein the second printing cylinder is rotated, while the second impression cylinder is held away therefrom, one complete revolution plus an angle corresponding to the difference between the circumference of the second printing cylinder and the second dimension of the second image portion.

5. A rotary printing press capable of printing elongate images on a continous web of material, comprising:

(a) a first printing unit having a first printing cylinder and a first impression cylinder, the first printing cylinder coacting with the first impression cylinder for printing on a web a first image portion having a first dimension, in the longitudinal direction of the web, that is not more than the circumference of the first printing cylinder;

(b) a second printing unit having a second cylinder and a second impression cylinder, the second printing cylinder coacting with the second impression cylinder for printing on the web a second imag portion having a second dimension, in the longitudinal direction of the web, that is not more than the circumference of the second printing cylinder;

(c) first actuator means for moving the first impression cylinder of the first printing unit into and out of rolling contact with the first printing cylinder via the web in order to cause the first image portion to be printed on the web at first prescribed spacings each having the second dimension in the longitudinal direction of the web;

(d) second actuator means for moving the second impression cylinder of the second printing unit into and out of rolling contact with the second printing cylinder via the web in order to cause the second image portion to be printed on the web at second prescribed spacings each having the first dimension in the longitudinal direction of the web;

(e) first variable speed drive means for rotating the first rotating cylinder of the first printing unit, while each time the first impression cylinder is being held away therefrom, at a variable speed through an angle necessary for causing the first image portion to be printed on the web at the first prescribed spacings; and (f) second variable speed drive means for rotating the second printing cylinder of the second printing unit, while each time the second impression cylinder is being held away therefrom, at a variable speed through an angle necessary for causing the second image portion to be printed on the web at the second prescribed spacings.

6. The rotary printing press of claim 5 wherein each of the first and the second actuator means, comprising:

(a) frame means;

(b) a pair of eccentric antifriction bearings rotatably mounted to the frame means, the first and the second impression cylinders being each supported by the pair of bearings for rotation about an axis off an axis of rotation of the bearings relative to the frame means; and (c) a pair of linear actuators operatively coupled respectively to the pair of bearings for bidirectionally rotating the bearings relative to the frame means.

7. The rotary printing press of claim 5 wherein each of the first and the second variable speed drive means comprises a variable speed electric motor drivingly coupled to the printing cylinder.

* * * * *